US008662488B2

(12) United States Patent
Awano

(10) Patent No.: US 8,662,488 B2
(45) Date of Patent: Mar. 4, 2014

(54) POST-PROCESSING DEVICE AND IMAGE FORMING APPARATUS

(75) Inventor: Hiroaki Awano, Yokohama (JP)

(73) Assignee: Fuji Xerox Co., Ltd., Tokyo (JP)

( * ) Notice: Subject to any disclaimer, the term of this patent is extended or adjusted under 35 U.S.C. 154(b) by 15 days.

(21) Appl. No.: 13/348,391

(22) Filed: Jan. 11, 2012

(65) Prior Publication Data

US 2013/0043637 A1 Feb. 21, 2013

(30) Foreign Application Priority Data

Aug. 19, 2011 (JP) ..... 2011-179881

(51) Int. Cl.
*B42C 1/12* (2006.01)

(52) U.S. Cl.
USPC ..... 270/58.08; 270/58.07

(58) Field of Classification Search
USPC ..... 270/52.18, 58.07, 58.08; 399/407, 408
See application file for complete search history.

(56) References Cited

U.S. PATENT DOCUMENTS

| | | | | |
|---|---|---|---|---|
| 3,577,575 | A | 5/1971 | Taniguchi | |
| 5,899,841 | A * | 5/1999 | Berger | 493/351 |
| 2011/0233844 | A1 * | 9/2011 | Shiraishi et al. | 270/58.11 |

FOREIGN PATENT DOCUMENTS

| | | | |
|---|---|---|---|
| JP | 49-5960 | B | 2/1974 |
| JP | 2903492 | B | 6/1999 |
| JP | 2000318918 | A * | 11/2000 |

* cited by examiner

*Primary Examiner* — Leslie A Nicholson, III
(74) *Attorney, Agent, or Firm* — Sughrue Mion, PLLC

(57) ABSTRACT

The post-processing device includes: a binding unit that forms a cut in a sheet stack and cuts a part of the sheet stack into a predetermined shape to form a tongue portion in the sheet stack, the tongue portion having a part where one end part of the tongue portion is not separated from the sheet stack, and binds the sheet stack by bending the tongue portion and inserting the other end part of the tongue portion into the cut; and a sheet stack transport unit that transports the sheet stack in an orientation such that the one end part of the tongue portion in the sheet stack bound by the binding unit is on a downstream side of the other end part of the tongue portion in the sheet stack transport direction.

13 Claims, 8 Drawing Sheets

POST-PROCESSING DEVICE AND IMAGE FORMING APPARATUS

CROSS REFERENCE TO RELATED APPLICATIONS

This application is based on and claims priority under 35 USC §119 from Japanese Patent Application No. 2011-179881 filed Aug. 19, 2011.

BACKGROUND

1. Technical Field

The present invention relates to a post-processing device and an image forming apparatus.

2. Related Art

Conventionally, there is known a technique for sealing or binding documents without using staples, adhesives or the like.

SUMMARY

According to an aspect of the present invention, there is provided a post-processing device including: a binding unit that forms a cut in a sheet stack and cuts a part of the sheet stack into a predetermined shape to form a tongue portion in the sheet stack, the tongue portion having a part where one end part of the tongue portion is not separated from the sheet stack, and binds the sheet stack by bending the tongue portion and inserting the other end part of the tongue portion into the cut; and a sheet stack transport unit that transports the sheet stack in an orientation such that the one end part of the tongue portion in the sheet stack bound by the binding unit is on a downstream side of the other end part of the tongue portion in the sheet stack transport direction.

BRIEF DESCRIPTION OF THE DRAWINGS

An exemplary embodiment of the present invention will be described in detail based on the following figures, wherein.

DETAILED DESCRIPTION

Hereinafter, an exemplary embodiment of the present invention will be described in detail with reference to the attached drawings.

<Image Forming System 1>

Figure 1:
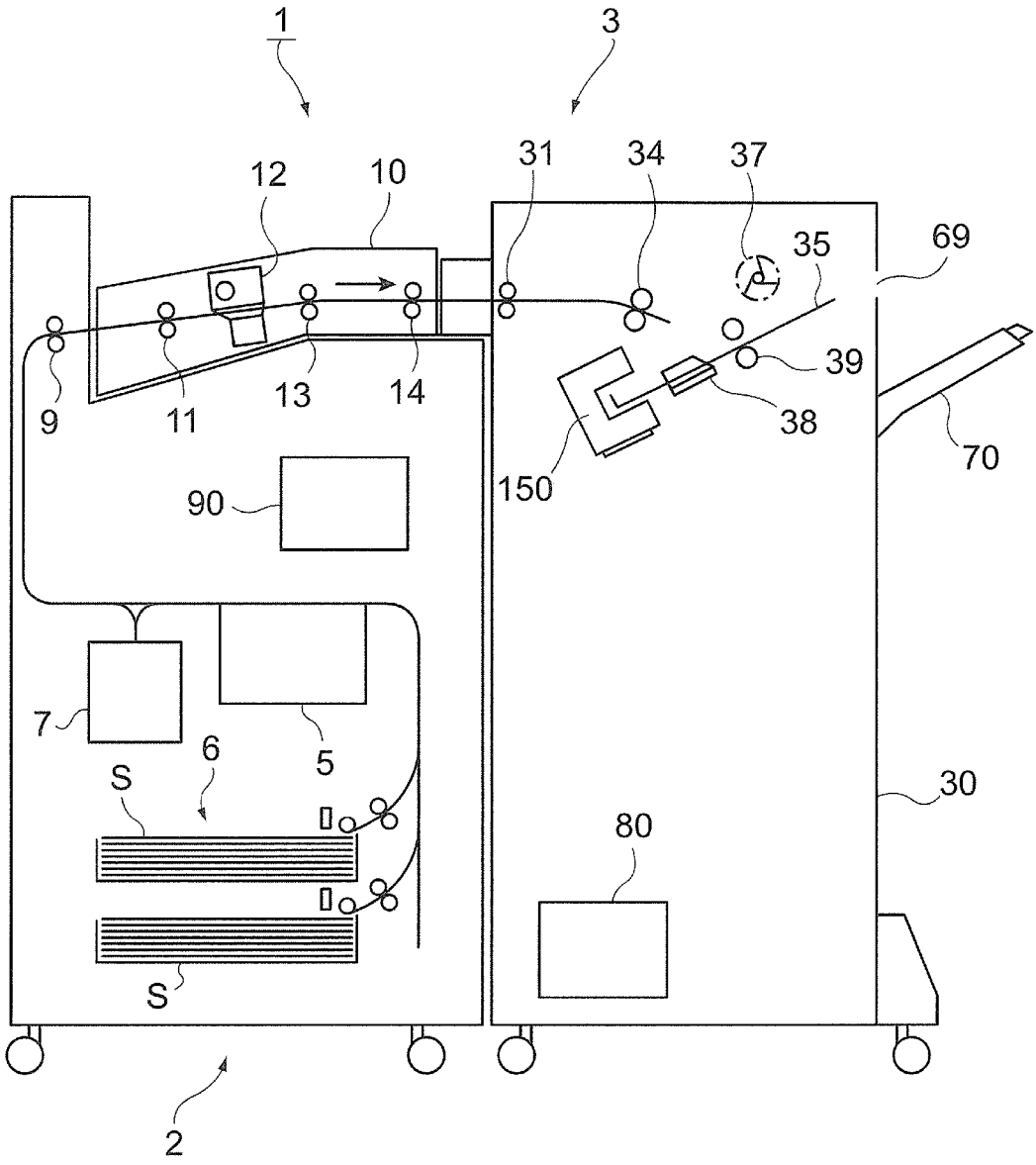
FIG. 1 is a schematic configuration diagram showing an image forming system to which an exemplary embodiment of the present invention is applied.

FIG. 1 is a schematic configuration diagram showing an image forming system (image forming apparatus) 1 to which the exemplary embodiment is applied. The image forming system 1 shown in FIG. 1 includes, for example, an image forming device 2 such as a printer or a copying machine that forms an image by an electrophotographic system, and a sheet processing device 3 that applies a post process to a sheet S on which, for example, a toner image is formed by the image forming device 2.

<Image Forming Device 2>

The image forming device 2 includes a sheet supply unit 6 that supplies the sheet S on which an image is to be formed and an image forming unit (image forming mechanism) 5 that forms an image on the sheet S supplied from the sheet supply unit 6. The image forming device 2 also includes a sheet inversion device 7 that inverts a face of the sheet S on which the image is formed by the image forming unit 5, and an output roll 9 that outputs the sheet S on which the image is formed. Further, the image forming device 2 includes a user interface 90 that receives information regarding the binding process from a user.

<Sheet Processing Device 3>

The sheet processing device 3 includes a transport device 10 that further transports the sheet S outputted from the image forming device 2 to the downstream side, and a post-processing device 30 including, for example, a compile stacking unit 35 that collects the sheets S and forms a sheet stack, a stapleless binding mechanism (binding unit) 150 that binds end portions of the sheets S or the like. Further, in the example shown in the figure, the sheet processing device 3 includes a controller 80 that controls the image forming system 1 as a whole.

The transport device 10 of the sheet processing device 3 includes an entrance roll 11 that is a pair of rolls to receive the sheet S outputted via the exit roll 9 of the image forming device 2, and a puncher 12 that makes a hole in the sheet S received by the entrance roll 11 as necessary. Moreover, on a further downstream side of the puncher 12, the transport device 10 has a first transport roll 13, which is a pair of rolls to transport the sheet S to the downstream side, and a second transport roll 14, which is also a pair of rolls to transport the sheet S toward the post-processing device 30.

The post-processing device 30 of the sheet processing device 3 includes a receiving roll 31, which is a pair of rolls to receive the sheet S from the transport device 10. The post-processing device 30 also includes the compile stacking unit 35 that is provided on a downstream side of the receiving roll 31, collects plural sheets and contains thereof, and an exit roll 34, which is a pair of rolls to allow the sheet S to exit toward the compile stacking unit 35.

Further, the post-processing device 30 includes paddles 37 that rotate so as to push the sheet S toward an end guide 35*b* (described later) of the compile stacking unit 35. Moreover, the post-processing device 30 includes a tamper 38 for aligning end portions of the sheets S. Still further, the post-processing device 30 includes an eject roll (sheet stack transport unit) 39 that transports a bound sheet stack B by pressing down the sheets S collected at the compile stacking unit 35 and rotating.

Further, the post-processing device 30 includes the stapleless binding mechanism 150 that binds an end portion of the sheet stack B stacked at the compile stacking unit 35. Still further, the post-processing device 30 includes an opening portion 69 for letting the sheet stack B exit to the outside of the post-processing device 30 by the eject roll 39. The post-processing device 30 also includes a stacking unit 70 for stacking the sheet stack B outputted from the opening portion 69 so that a user can easily pick up the sheet stack B.

<Configuration of Periphery of Compile Stacking Unit 35>

Next, with reference to FIGS. 2 and 3, configuration of the compile stacking unit 35 and the periphery thereof will be described. Here, FIG. 2 is a schematic configuration diagram showing the periphery of the compile stacking unit 35, and FIG. 3 is a schematic configuration diagram showing the periphery of the compile stacking unit 35 as viewed from direction III in FIG. 2.

Figure 2:
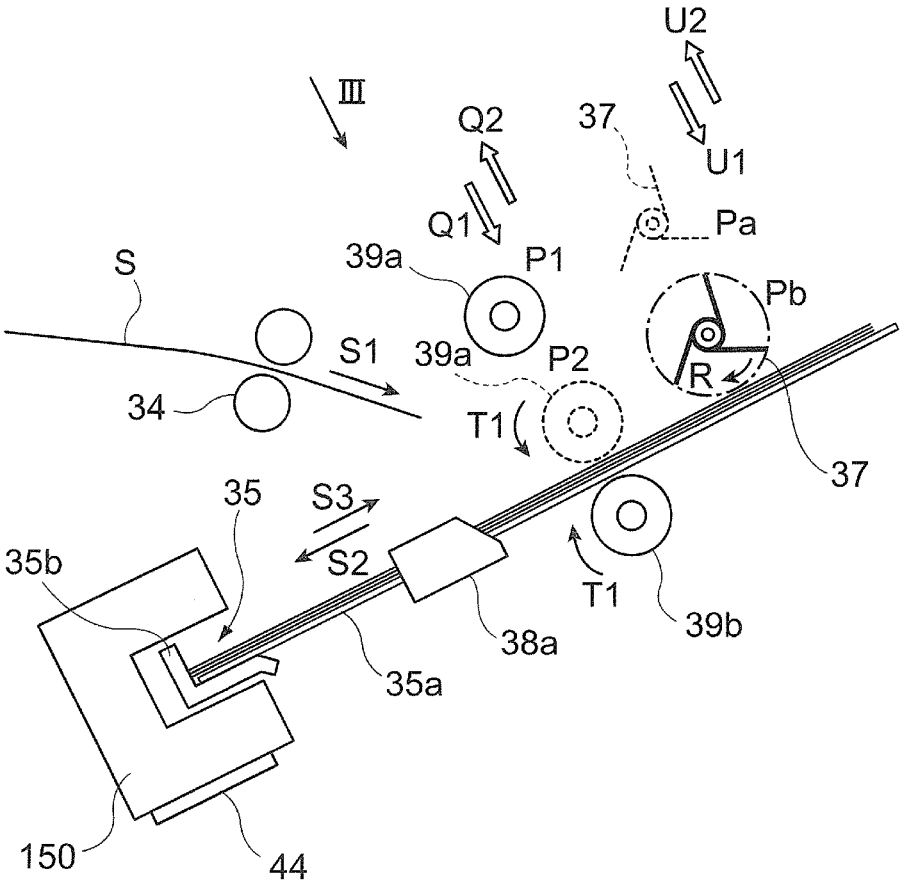
FIG. 2 is a schematic configuration diagram showing a periphery of a compile stacking unit.
Figure 3:
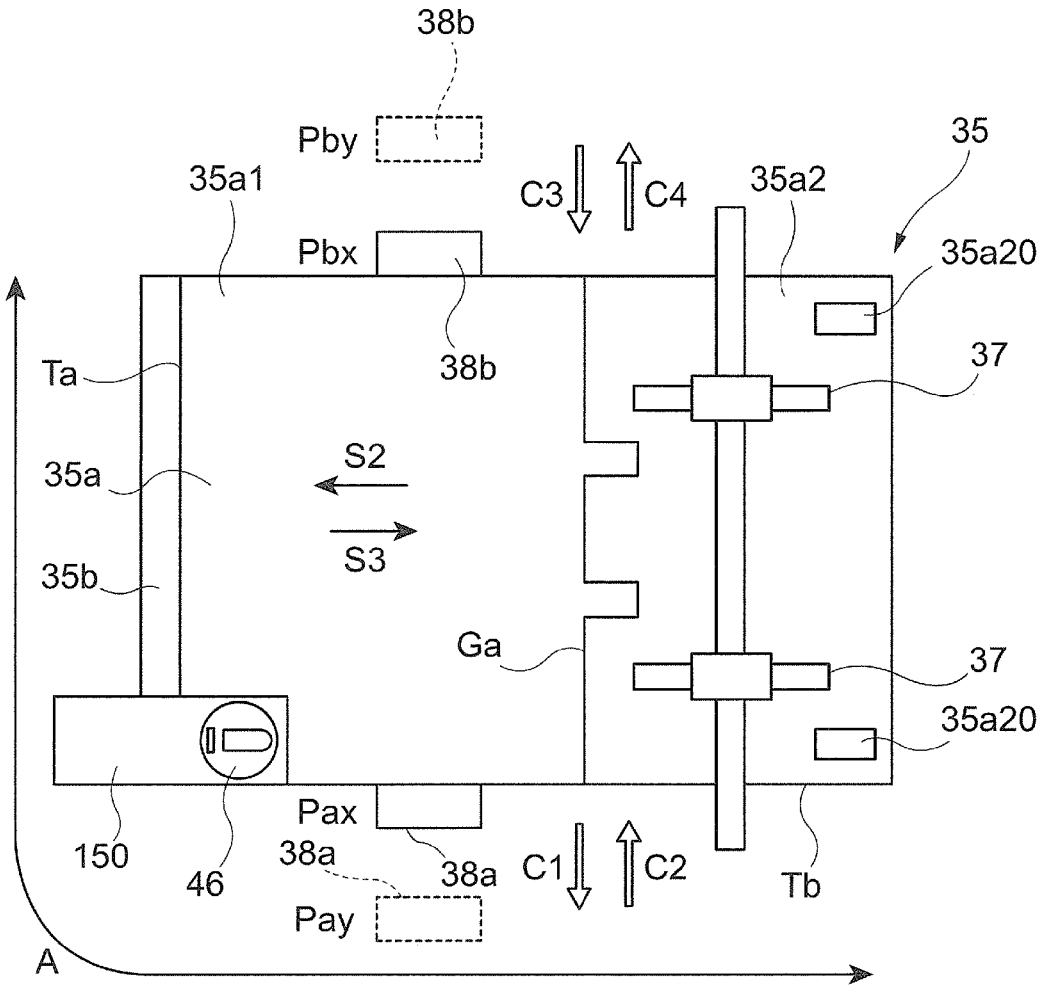
FIG. 3 is a schematic configuration diagram showing the periphery of the compile stacking unit as viewed from direction III in FIG. 2.

It should be noted that the lower side in FIG. 3 indicates a user side of the image forming system 1, which is a frontward side of the page in FIGS. 1 and 2.

First, the compile stacking unit (sheet stack forming mechanism) 35 includes a bottom portion 35*a* having a top surface for stacking the sheets S. As shown in FIG. 3, the bottom portion 35*a* is constituted by a first member 35*a*1 and a second member 35*a*2, and the first member 35*a*1 and the second member 35*a*2 are connected via a joint portion Ga. In the second member 35*a*2 of the bottom portion 35*a*, secure holes 35*a*20 are formed for securing the bottom portion 35*a* to a support member (not shown) by bolts or the like (not shown). As shown in FIG. 2, the bottom portion 35*a* is provided at a slant so that the sheets S slide down along the top surface.

Further, the compile stacking unit 35 includes an end guide 35*b* that is arranged to align end portions on a leading end side in the traveling direction of the sheets S sliding down along the bottom portion 35*a*.

It should be noted that, though later described in detail, movement of the sheets S in the periphery of the compile stacking unit 35 is as follows: first, the sheets S are supplied toward the compile stacking unit 35 (refer to the first traveling direction S1 shown in FIG. 2), then invert the traveling direction thereof and slide down along the bottom portion 35*a* of the compile stacking unit 35 (refer to the second traveling direction S2 shown in FIG. 2). Thereafter, the end portion of each sheet S is aligned to form the sheet stack B. The sheet stack B inverts the traveling direction thereof to climb up along the bottom portion 35*a* of the compile stacking unit 35 (refer to the third traveling direction S3 shown in FIG. 2).

Here, as shown in FIG. 3, each end portion of the bottom portion 35*a* of the compile stacking unit 35 is defined as follows: an end portion on the leading end side in the second traveling direction S2, which indicates a direction of the sheets S sliding down along the top surface of the bottom portion 35*a* of the compile stacking unit 35, is referred to as a leading-end-side end portion Ta. The leading-end-side end portion Ta contacts the end guide 35*b*. Further, an end portion along the second traveling direction S2 and on the user side of the image forming system 1 (lower side in FIG. 3) is referred to as a lateral-direction end portion Tb.

Next, the paddles 37 are provided above the compile stacking unit 35 and on a downstream side in the first traveling direction S1 of the sheets S with respect to the exit roll 34. Further, the paddles 37 are provided so that the distance between the paddles 37 and the bottom portion 35*a* of the compile stacking unit 35 varies upon receiving a drive of a motor or the like not shown in the figure. Specifically, the paddles 37 are provided to be movable in the directions of arrows U1 and U2 in FIG. 2: the paddles 37 move in the direction of arrow U1 to approach the bottom portion 35*a* of the compile stacking unit 35 (position Pb drawn in solid lines); and the paddles 37 move in the direction of arrow U2 to move away from the bottom portion 35*a* of the compile stacking unit 35 (position Pa drawn in broken lines). The paddles 37 are configured to push the sheet S, which has been transported along the first traveling direction S1 in FIG. 2, into the second traveling direction S2 on the compile stacking unit 35 by rotating in the direction of arrow R in FIG. 2.

The tamper 38 (refer to FIG. 1) is, as shown in FIG. 3, constituted by a first tamper 38*a* and a second tamper 38*b* facing each other with the compile stacking unit 35 interposed therebetween. Specifically, the first tamper 38*a* and the second tamper 38*b* are arranged to face each other in a direction intersecting the second traveling direction S2 (vertical direction in FIG. 3). The first tamper 38*a* and the second tamper 38*b* are provided so that the distance between the first tamper 38*a* and the second tamper 38*b* varies upon receiving a drive of a motor or the like not shown in the figure.

Here, the tamper 38 is configured to align the end portions of the sheets S along the traveling direction of the sheets S which slide down along the bottom portion 35*a*. Specifically, the first tamper 38*a* is arranged to move between a position to approach the compile stacking unit 35 (position Pax drawn in a solid line) and a position to move away from the compile stacking unit 35 (position Pay drawn in a broken line) (arrows C1 and C2). On the other hand, the second tamper 38*b* is arranged to move between a position to approach the compile stacking unit 35 (position Pbx drawn in a solid line) and a position to move away from the compile stacking unit 35 (position Pby drawn in a broken line) (arrows C3 and C4).

It should be noted that each position of the first tamper 38*a* and the second tamper 38*b*, namely, Pax, Pay, Pbx and Pby in the exemplary embodiment may be changed according to a sheet size or orientation of the sheets S supplied to the compile stacking unit 35.

The eject roll 39 is constituted by a first eject roll 39*a* and a second eject roll 39*b*, and the first eject roll 39*a* and the second eject roll 39*b* are arranged to face each other, with the bottom portion 35*a* interposed therebetween, on an upper side and a lower side of the bottom portion 35*a* of the compile stacking unit 35.

The first eject roll 39*a* is provided on a side of the surface of the bottom portion 35*a* of the compile stacking unit 35, on which surface the sheets S are stacked. Further, the first eject roll 39*a* is provided to be movable back and force with respect to the second eject roll 39*b* upon receiving a drive of a motor or the like not shown in the figure. That is, the first eject roll 39*a* is configured so that the distance between the first eject roll 39*a* and the sheets S stacked on the bottom portion 35*a* of the compile stacking unit 35 is varied. On the other hand, the second eject roll 39*b* is arranged on a backside of the surface of the bottom portion 35*a* of the compile stacking unit 35, on which surface the sheets S are stacked, and the position thereof is fixed to only perform rotational motion.

Specifically, the first eject roll 39*a* moves toward the direction of arrow Q1 to approach the bottom portion 35*a* of the compile stacking unit 35 (position P2 drawn in broken lines). On the other hand, the first eject roll 39*a* moves toward the direction of arrow Q2 to move away from the bottom portion 35*a* of the compile stacking unit 35 (position P1 drawn in solid lines).

Further, the first eject roll 39*a* is configured to make the sheet stack B climb up (third traveling direction S3) and transport thereof by rotating in the direction of arrow T1 upon receiving a drive of a motor or the like not shown in the figure in contact with the sheets S.

It should be noted that the positions of the first eject roll 39*a*, namely, P1 and P2 may be changed according to the number of sheets or thickness of the sheets S supplied to the compile stacking unit 35.

<Stapleless Binding Mechanism 150 and Peripheral Members Thereof>

Next, with reference to FIG. 4, the stapleless binding mechanism 150 and peripheral members thereof will be described. Here, FIG. 4 is a schematic configuration diagram showing the stapleless binding mechanism 150 and the peripheral members thereof.

Figure 4:
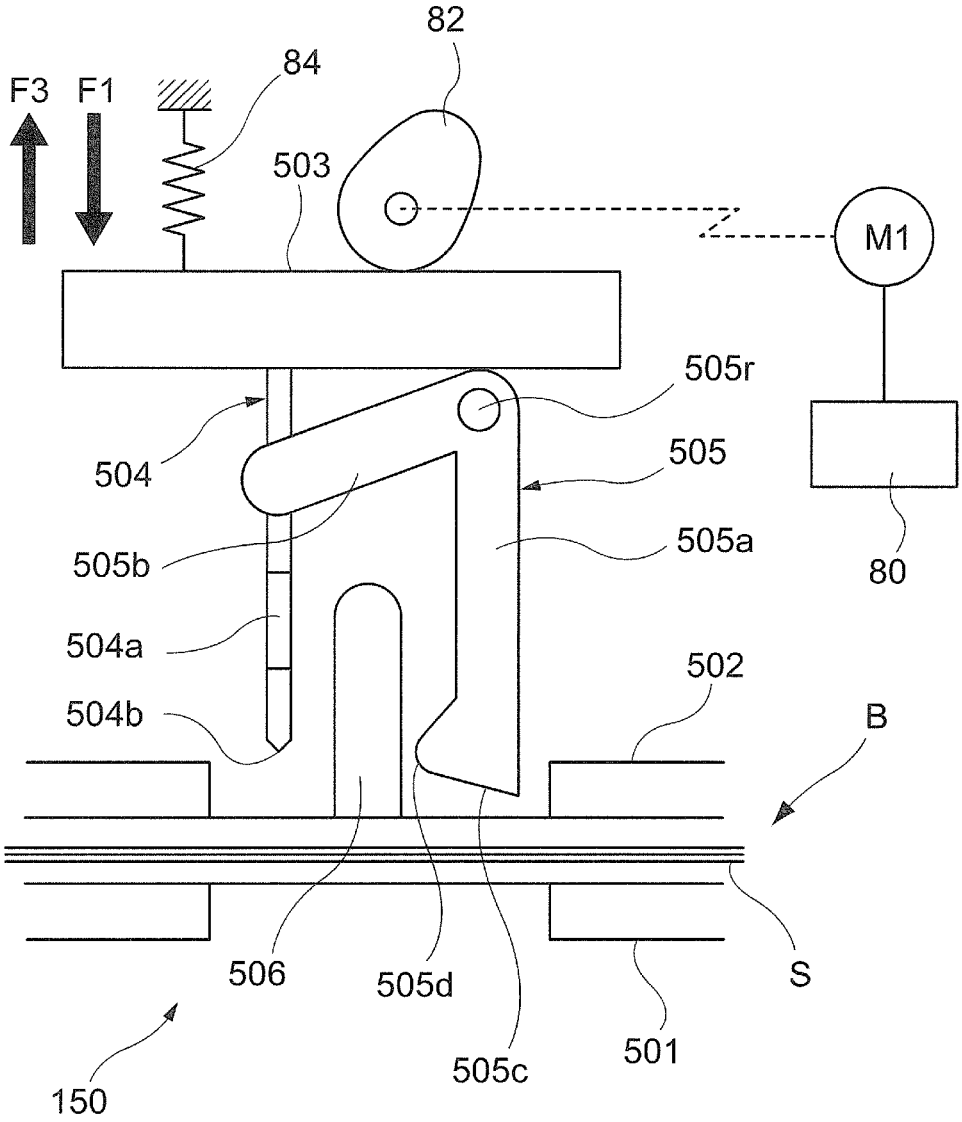
FIG. 4 is a schematic configuration diagram showing a stapleless binding mechanism and peripheral members thereof.

The image forming system 1 (refer to FIG. 1) has, as shown in FIG. 4, a stapleless binding motor M1 that drives the stapleless binding mechanism 150 under the control of the controller 80. The image forming system 1 (refer to FIG. 1) also includes a cam 82 that transmits a driving force to the stapleless binding mechanism 150 by rotating upon receiving a drive from the stapleless binding motor M1, and a spring 84 that applies a force, which is opposite to the driving force transmitted by the cam 82, to the stapleless binding mechanism 150.

Further, the image forming system 1 (refer to FIG. 1) includes a moving mechanism 44 (refer to FIG. 2) having a rail for moving the stapleless binding mechanism 150 according to the position where the binding process is to be performed in the sheet stack B, and a rotating mechanism 46 (refer to FIG. 3) having a motor for rotating a base portion 503 (described later) of the stapleless binding mechanism 150 according to the orientation (described later) in which the binding process is performed in the sheet stack B. It should be noted that the stapleless binding mechanism 150 in the exemplary embodiment moves along the leading-end-side end portion Ta or the lateral-direction end portion Tb of the bottom portion 35*a* by the moving mechanism 44 (refer to arrow A in FIG. 3).

<Configuration of Stapleless Binding Mechanism 150>

Next, description will be given to configuration of the stapleless binding mechanism (binding mechanism) 150 with reference to FIG. 4. The stapleless binding mechanism 150 binds the end portion of the sheet stack B without using binding staples for a stapler (so-called staples) by deforming the sheets S constituting the sheet stack B. Specifically, the configuration thereof is as follows.

The stapleless binding mechanism 150 has a base stage 501 and the base portion 503 that are arranged to face each other. As shown in FIG. 4, the stapleless binding mechanism 150 is configured so that the base portion 503 approaches the base stage 501 (direction F1 in the figure) in the state where the sheet stack B is held by the base stage 501, and thereby the sheet stack B is bound.

As shown in FIG. 4, in the base stage 501, a holding member 502 is arranged substantially in parallel to the base stage 501. The base stage 501 and the holding member 502 are provided with the bottom portion 35*a* (refer to FIG. 2) of the compile stacking unit 35 interposed therebetween, and therefore the sheet stack B stacked on the compile stacking unit 35 is sandwiched by the base stage 501 and the holding member 502. Moreover, as shown in FIG. 4, the base stage 501 includes a projection portion 506 that extends toward the base portion 503 and is formed integrally with the base stage 501.

The base portion 503 includes a blade 504 that makes a cut in the sheet stack B and a punching member 505 that forms a tongue portion 522 (described later) in the sheet stack B and bends thereof, and then inserts the tongue portion 522 into the cut formed by the blade 504.

The blade 504 is constituted by a substantially rectangular plate-like member that extends toward the sheet stack B sandwiched between the base stage 501 and the holding member 502. Specifically, the blade 504 has an eyelet 504*a* in a substantially rectangular surface and a tip portion 504*b* the width of which is reduced as approaching the sheet stack B.

The punching member 505 includes an L-shaped bending portion. One end portion of the punching member 505 is a main portion 505*a*, and the other end portion is a sub-portion 505*b*.

Further, the punching member 505 has a main portion rotational axis 505*r* provided in the L-shaped bending portion. The punching member 505 is rotatable around the main portion rotational axis 505*r*. More specifically, the main portion 505*a* is able to be inclined toward the blade 504. It should be noted that a gap is provided between the sub-portion 505*b* and the base portion 503 so that the punching member 505 is rotatable.

Here, the main portion 505*a* extends toward the base stage 501. Further, the main portion 505*a* includes a blade portion 505*c* on a side opposite to the side where the main portion rotational axis 505*r* is provided, namely, on a side facing the base stage 501. The blade portion 505*c* is constituted by a blade that punches the shape of the tongue portion 522. It should be noted that, in the blade portion 505*c*, no blade is formed on a side facing the blade 504, and thereby the tongue portion 522 is not separated from the sheet S via a one end part 522*a*, which will be described later. Further, the main portion 505*a* includes a protrusion 505*d*, extending toward the blade 504, on a side part of the main portion 505*a*, specifically, on a side facing the blade 504.

<Operation of Stapleless Binding Mechanism 150>

Figure 5A:
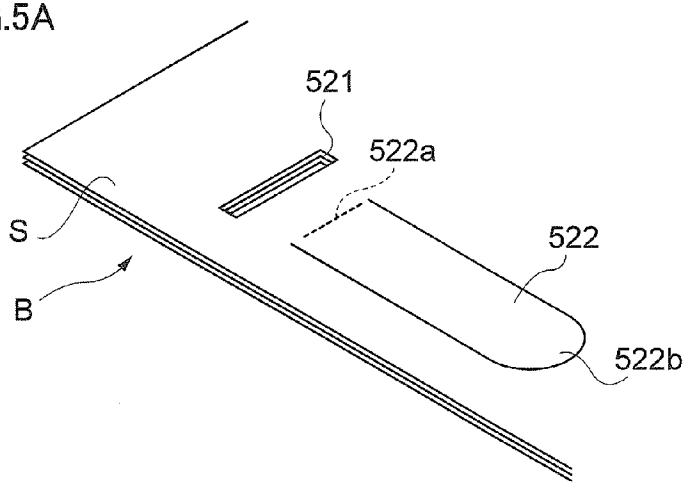
FIGS. 5A to 5D are illustrative diagrams showing a portion bound by the stapleless binding mechanism.
Figure 5B:
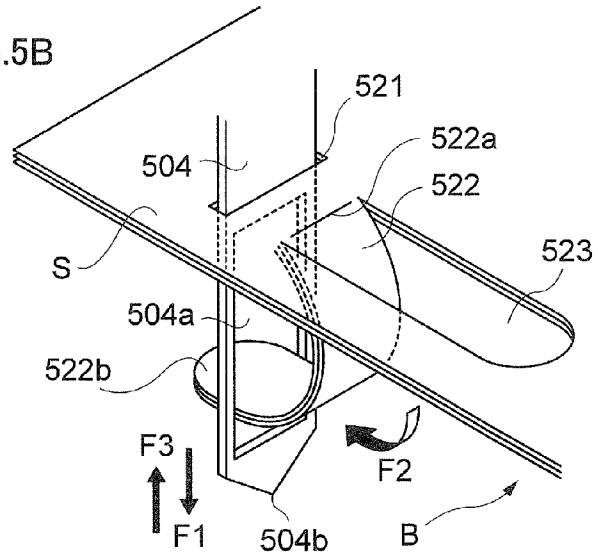
Figure 5C:
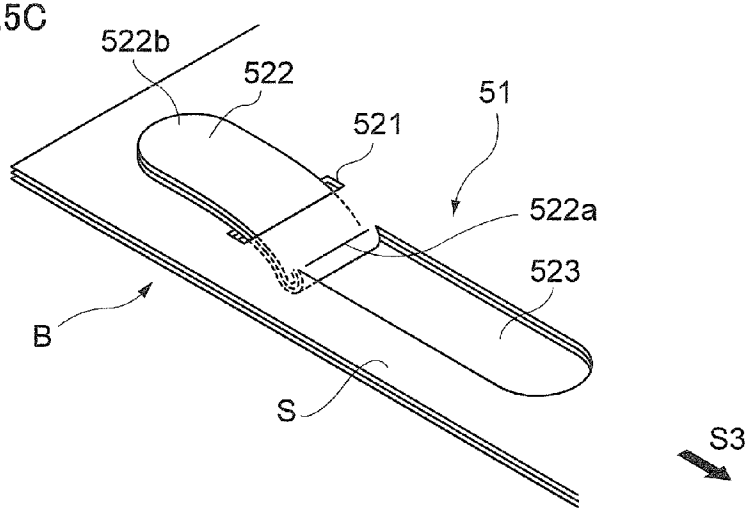
Figure 5D:
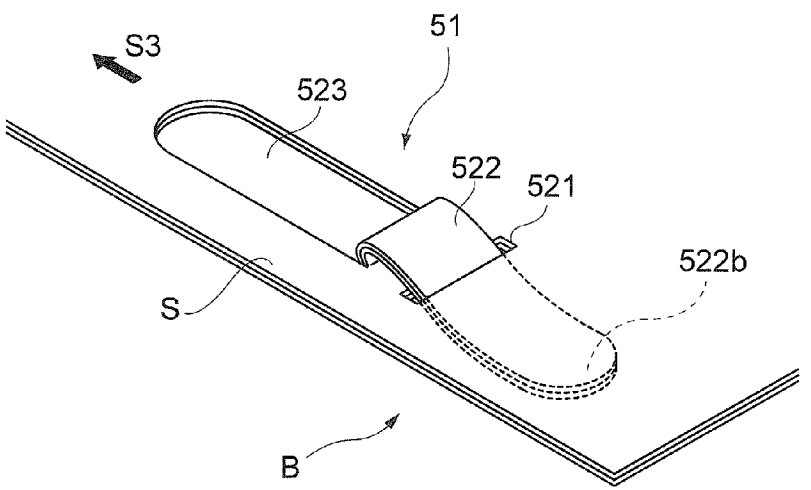

With reference to FIGS. 1 to 5A-5D, specific description will be given to an operation of binding the end portion of the sheet stack B stacked on the compile stacking unit 35 by use of the stapleless binding mechanism 150. Here, FIGS. 5A to 5D are illustrative diagrams showing a portion bound by the stapleless binding mechanism 150. In more detail, FIG. 5A is an illustrative diagram showing a positional relationship between a slit 521 and the tongue portion 522, FIG. 5B is an illustrative diagram showing a relationship between the slit 521 and the tongue portion 522 when the stapleless binding mechanism 150 performs binding, FIG. 5C is an illustrative diagram showing a front-surface side of a binding section 51, and FIG. 5D is an illustrative diagram showing a back-surface side of the binding section 51.

First, when the sheet stack B to which the binding process is applied is stacked on the compile stacking unit 35, upon receiving a signal from the controller 80, the moving mechanism 44 and the rotating mechanism 46 cause the stapleless binding mechanism 150 to move toward the position and orientation in which the binding process is performed in the sheet stack B.

At this position, the stapleless binding motor M1, which has received instructions from the controller 80, drives to rotate the cam 82. This makes the base portion 503 approach the base stage 501 (direction F1 in the figure), and the tip portion 504*b* of the blade 504 and the blade portion 505*c* of the punching member 505 cut through the sheet stack B. Accordingly, in each sheet S constituting the sheet stack B, the slit (cut) 521 and the tongue portion 522 in which the sheet S is punched with the one end part 522*a* left are formed (refer to FIG. 5A)

Then, as shown in FIG. 4, as the cam 82 rotates to further press down the base portion 503, the sub-portion 505*b* of the punching member 505 bumps against the projection portion 506 formed integrally with the base stage 501, and the punching member 505 rotates around the main portion rotational axis 505*r* in the clockwise direction in FIG. 4. Consequently, the main portion 505*a* is inclined toward the blade 504, and the protrusion 505*d* of the punching member 505 approaches the blade 504. Then, as shown in FIG. 5B, the protrusion 505*d* of the punching member 505 bends the tongue portion 522, and pushes thereof in the direction F2 in the figure toward the eyelet 504*a* of the blade 504. It should be noted that the punching member 505 is not shown in FIG. 5B.

As shown in FIG. 4, after passing through the bottom dead center by further rotation of the cam 82, while receiving a force from the spring 84, the base portion 503 moves in the direction away from the base stage 501 (refer to F3 in the figure). As the base portion 503 rises in the direction F3 in the figure, the tongue portion 522 also rises in the state of being caught in the eyelet 504*a* of the blade 504. Then, as shown in FIGS. 5C and 5D, the sheet stack B is bound by inserting the tongue portion 522 into the slit 521 (bending the tongue portion 522 and pushing thereof into the slit 521). At this time, in the sheet stack B, a binding hole 523 is formed at the position where the tongue portion 522 has punched. It should be noted that, in the exemplary embodiment, the slit 521, the tongue portion 522 and the binding hole 523 are referred to as a section in which the binding process is applied (binding section) 51.

<Operation of Image Forming System 1>

Next, with reference to FIGS. 1 to 3, operations of the image forming system 1 will be described.

First, in the exemplary embodiment, information regarding an image to be formed on the sheet S and the binding process is received via a personal computer (not shown) or the user interface 90. Upon receiving the information by the controller 80, operations of the image forming system 1 are started.

It should be noted that, in a state prior to forming a toner image on the first sheet S by the image forming unit 5 of the image forming device 2, each member is arranged as follows: the first eject roll 39*a* is arranged at the position P1; the paddles 37 are arranged at the position Pa; the first tamper 38*a* is arranged at the position Pay; and the second tamper 38*b* is arranged at the position Pbx.

Then, the toner image is formed on the first sheet S by the image forming unit 5 of the image forming device 2. As shown in FIG. 1, the first sheet S on which the toner image is formed is inverted by the sheet inversion device 7 if needed, and thereafter, supplied one by one to the sheet processing device 3 via the output roll 9.

In the transport device 10 of the sheet processing device 3, to which the first sheet S has been supplied, the first sheet S is received at the entrance roll 11 and a punching process is applied to the first sheet S by the puncher 12 as necessary. Thereafter, the first sheet S is transported toward the post-processing device 30 provided on the downstream side via the first transport roll 13 and the second transport roll 14.

In the post-processing device 30, the first sheet S is received by the receiving roll 31. The first sheet S passed through the receiving roll 31 is transported along the first traveling direction S1 by the exit roll 34. At this time, the first sheet S is transported so as to pass between the compile stacking unit 35 and the first eject roll 39*a*, and between the compile stacking unit 35 and the paddles 37.

After the leading edge of the first sheet S in the first traveling direction S1 is passed between the compile stacking unit 35 and the paddles 37, the paddles 37 move down from the position Pa (move in the direction of arrow U1 in FIG. 2) to be arranged at the position Pb. This makes the paddles 37 contact the first sheet S. Then, due to the rotation of the paddles 37 in the direction of arrow R in FIG. 2, the first sheet S is pushed in the second traveling direction S2 in FIG. 2, and thereby the end portion of the first sheet S facing the end guide 35*b* is brought into contact with the end guide 35*b*. Thereafter, the paddles 37 are raised (move in the direction of arrow U2 in FIG. 2) to move away from the first sheet S, and are arranged at the position Pa again.

Further, after the first sheet S is received by the compile stacking unit 35 and the end portion thereof facing the end guide 35*b* reaches the end guide 35*b*, the first tamper 38*a* approaches the compile stacking unit 35 from the position Pay (moves in the direction of arrow C2 in FIG. 3) to be arranged at the position Pax. At this time, the second tamper 38*b* is still arranged at the position Pbx. This causes the first tamper 38*a* to push the first sheet S, and the first sheet S is brought into contact with the second tamper 38*b*. Thereafter, the first tamper 38*a* is separated from the first sheet S by moving away from the compile stacking unit 35 (moving in the direction of arrow C1 in FIG. 3), and is arranged at the position Pay again.

When each of the second and subsequent sheets S, following after the first sheet S, on which the toner image is formed by the image forming unit 5 is supplied to the post-processing device 30 in order, similar to the above operations, the end portions of the sheets S are aligned by the paddles 37 and the tamper 38. That is, the second sheet S is supplied in the state where the first sheet S is aligned, and the second sheet S is aligned with the first sheet S. The same is true on the case where the third and subsequent sheets S are supplied. In this way, a preset number of sheets S are contained in the compile stacking unit 35, the end portion of each sheet S is aligned, and the sheet stack B is formed.

The first eject roll 39*a* moves down from the position P1 (moves in the direction of arrow Q1 in FIG. 2) to be arranged at the position P2. Consequently, the sheet stack B in the aligned state is sandwiched by the first eject roll 39*a* and the second eject roll 39*b* to be secured.

Next, after the stapleless binding mechanism 150 is moved by the moving mechanism 44 to the portion where the binding process is to be applied (refer to arrow A), the stapleless binding mechanism 150 applies the binding process to the sheet stack B stacked on the compile stacking unit 35.

The sheet stack B bound by the stapleless binding mechanism 150 climbs up along the bottom portion 35*a* of the compile stacking unit 35 (refer to the third traveling direction S3 in FIG. 2) by the rotation of the first eject roll 39*a* (refer to arrow T1 in FIG. 2), and is ejected from the compile stacking unit 35. Then, the sheet stack B passes through the opening portion 69 to be outputted to the stacking unit 70.

<Relationship Between Orientation of Tongue Portion 522 and Transport Direction of Sheet Stack B>

Figure 6A:
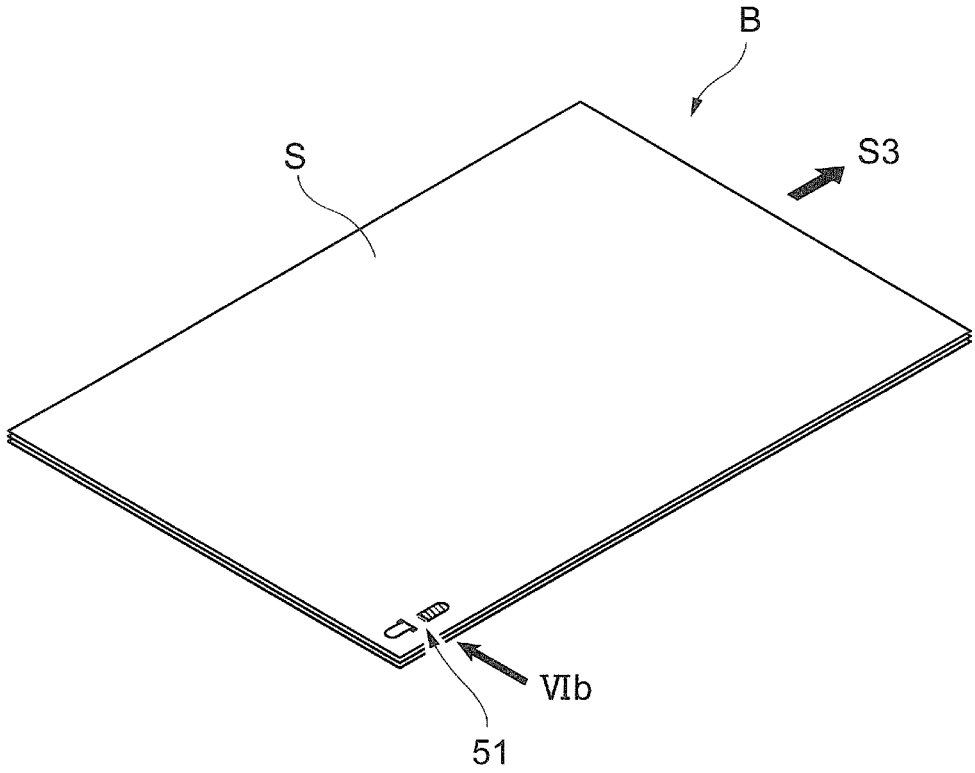
FIGS. 6A and 6B are schematic configuration diagrams showing a sheet stack subjected to a binding process.
Figure 6B:
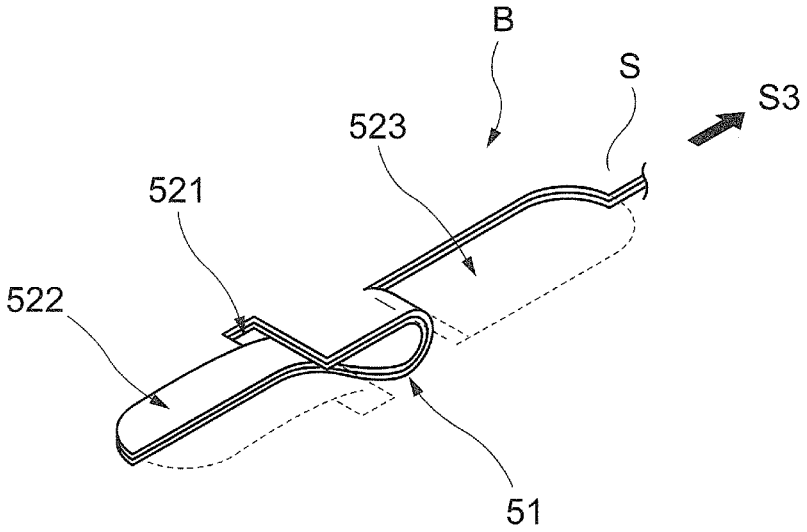
Figure 7:
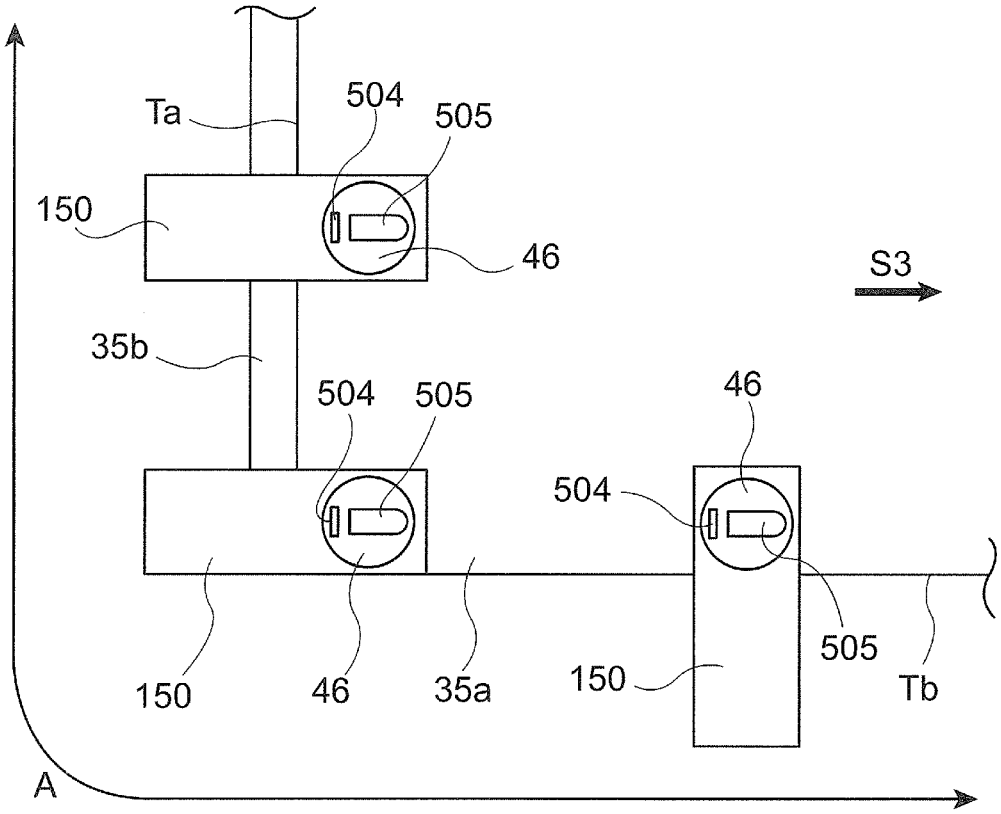
FIG. 7 is an illustrative diagram showing an orientation of the stapleless binding mechanism and an orientation of a binding section.

With reference to FIGS. 1 to 7, description will be given to a relationship between the orientation of the tongue portion 522 formed in the sheet stack B and the transport direction of the sheet stack B. Here, FIGS. 6A and 6B are schematic configuration diagrams showing the sheet stack B subjected to the binding process. More specifically, FIG. 6A is a perspective view showing the sheet stack B to which the binding process is applied, and FIG. 6B is a cross-sectional view of the binding section 51 as viewed from the direction of arrow VIb in FIG. 6A. Further, FIG. 7 is an illustrative diagram showing an orientation of the stapleless binding mechanism 150 and an orientation of the binding section 51.

As shown in FIG. 5C, in the exemplary embodiment, the tongue portion 522 is arranged so that the root of the tongue portion 522 (one end part 522*a*) is on the downstream side in the transport direction of the sheet stack B (the third traveling direction S3) with respect to the tip of the tongue portion 522 (the other end part 522*b*). In other words, the binding section 51 proceeds in the direction in which, after the root of the tongue portion 522 formed in the sheet stack B passes through a certain position in the transport path of the sheet stack B, which is transported in the third traveling direction S3, the tip of the tongue portion 522 passes through the same position. In other words, further, the binding section 51 proceeds in the direction in which the binding hole 523 formed in the sheet stack B is in the lead and the tongue portion 522 follows the binding hole 523.

In the exemplary embodiment, as shown in FIG. 3, the orientation of the binding section 51 (refer to FIG. 5C) with respect to the sheet stack B is not changed even in the case where the position of the stapleless binding mechanism 150 with respect to the compile stacking unit 35 is changed (refer to arrow A) by the moving mechanism 44 (refer to FIG. 2). Specifically, as shown in FIG. 7, the positional relationship between the blade 504 and the punching member 505 is not changed in the case where the stapleless binding mechanism 150 is arranged to face the leading-end-side end portion Ta of the bottom portion 35*a*, and also in the case where the stapleless binding mechanism 150 is arranged to face the lateral-direction end portion Tb of the bottom portion 35*a*.

In the specific example shown in the figure, even in the case where the stapleless binding mechanism 150 is moved, the punching member 505 is arranged on the downstream side of the blade 504 in the third traveling direction S3 due to the rotation of the base portion 503 (refer to FIG. 4) by the rotating mechanism 46. Accordingly, the root of the tongue portion 522 formed by the punching member 505 and inserted into the slit 521 is on the downstream side in the transport direction of the sheet stack B (third traveling direction S3) with respect to the tip of the tongue portion 522.

Further, in the exemplary embodiment, for example, the sheet stack B formed on the compile stacking unit 35 as described above is subjected to the binding process by the stapleless binding mechanism 150 in a state of being sandwiched by the first eject roll 39*a* and the second eject roll 39*b*. Then, the bound sheet stack B climbs up along the bottom portion 35*a* of the compile stacking unit 35 (refer to the third traveling direction S3 in FIG. 2) due to the rotation of the first eject roll 39*a* (arrow T1 in FIG. 2) while maintaining the state of being sandwiched by the first eject roll 39*a* and the second eject roll 39*b*.

Accordingly, while maintaining the positional relationship in which the root of the tongue portion 522 formed by the stapleless binding mechanism 150 is on the downstream side in the transport direction of the sheet stack B (the third traveling direction S3) with respect to the tip of the tongue portion 522, the sheet stack B is transported by the first eject roll 39*a* and the second eject roll 39*b*, passed through the opening portion 69, and outputted to the stacking unit 70 (refer to FIG. 1).

It should be noted that, as a configuration for maintaining the orientation of the sheet stack B so that the root of the tongue portion 522 is on the downstream side in the third traveling direction S3 with respect to the tip thereof, for example, a guide member (not shown) that guides the sheet stack B along the third traveling direction S3 may be provided.

Here, as shown in FIG. 6B, the tongue portion 522 inserted into the slit 521 protrudes from the surface of the sheet stack B due to being bent and inserted into the slit 521. In other words, the binding section 51 becomes a bulging section in the sheet stack B. Consequently, when the sheet stack B is transported, the tongue portion 522 protruding from the surface of the sheet stack B may possibly be caught on other members or the like arranged along the transport path of the sheet stack B.

In the exemplary embodiment, the root of the tongue portion 522 is on the downstream side of the tip thereof in the third traveling direction S3, as described above. This suppresses the possibility that the tongue portion 522 could be caught on the other members compared to, for example, the case where the tongue portion 522 is arranged so that the longitudinal direction thereof intersects the third traveling direction S3, or the case where, contrary to the exemplary embodiment, the tip of the tongue portion 522 is arranged on the downstream side of the root thereof in the third traveling direction S3.

To be described in more detail, there is a case where irregularities in heights such as the joint portion Ga or the secure holes 35*a*20 shown in FIG. 3 exist in the area where the binding section 51 passes through as the sheet stack B is transported. In this case, the possibility that the tongue portion 522 could be caught on the other members is suppressed by arranging the root of the tongue portion 522 on the downstream side of the tip thereof in the third traveling direction S3. Accordingly, the possibility that the tongue portion 522 could be caught on the other members and thereby the orientation of the transported sheet stack B is changed (disarranged) or that the sheet stack B is not outputted to the stacking portion 70 but stopped halfway in the transport path (ejection failure) is suppressed. Further, the possibility that the tongue portion 522 comes out of the slit 521 and the binding section 51 becomes unbind or that the tongue portion 522 is broken (damaged) caused by the tongue portion 522 caught on the other members is suppressed.

In addition, in the exemplary embodiment, the sheet stack B is transported so that the root of the tongue portion 522 is on the downstream side of the tip thereof in the third traveling direction S3 and the longitudinal direction of the tongue portion 522 is along the third traveling direction S3, as shown in FIG. 5C. Consequently, for example, in the case where the longitudinal direction of the tongue portion 522 is oblique with respect to the third traveling direction S3, the possibility that, as the tongue portion 522 receives a resisting force due to a frictional force or the like, the sheet stack B receives a force in a direction intersecting the third traveling direction S3 is suppressed. Accordingly, for example, skew of the sheet stack B is suppressed.

<Other Modes of Sheet Stack B Subjected to Binding Process>

Next, with reference to FIGS. 8A and 8B, other modes of the sheet stack B subjected to the binding process will be described. Here, FIGS. 8A and 8B are schematic configuration diagrams showing other modes of the sheet stack B subjected to the binding process.

In the exemplary embodiment described above, description is given to the formation of the binding section 51 at one position in a corner of the sheet stack B, but the present invention is not limited thereto. The plural binding sections 51 may be provided in the sheet stack B. The sheet stack B is bound more securely by binding the sheet stack B with the plural binding sections 51, and the possibility that the sheet stack B becomes unbind during transportation thereof is suppressed.

Here, the position of the binding section 51 in the sheet stack B is changed by moving the position of the stapleless binding mechanism 150 with respect to the compile stacking unit 35 by the moving mechanism 44. Further, the number of binding section 51 formed in one sheet stack B is changed by repeating the binding operation while moving the position of the stapleless binding mechanism 150 by the moving mechanism 44. Moreover, the angle of the binding section 51 in the sheet stack B is changed by rotating the base portion 503 of the stapleless binding mechanism 150 by the rotating mechanism 46.

Figure 8A:
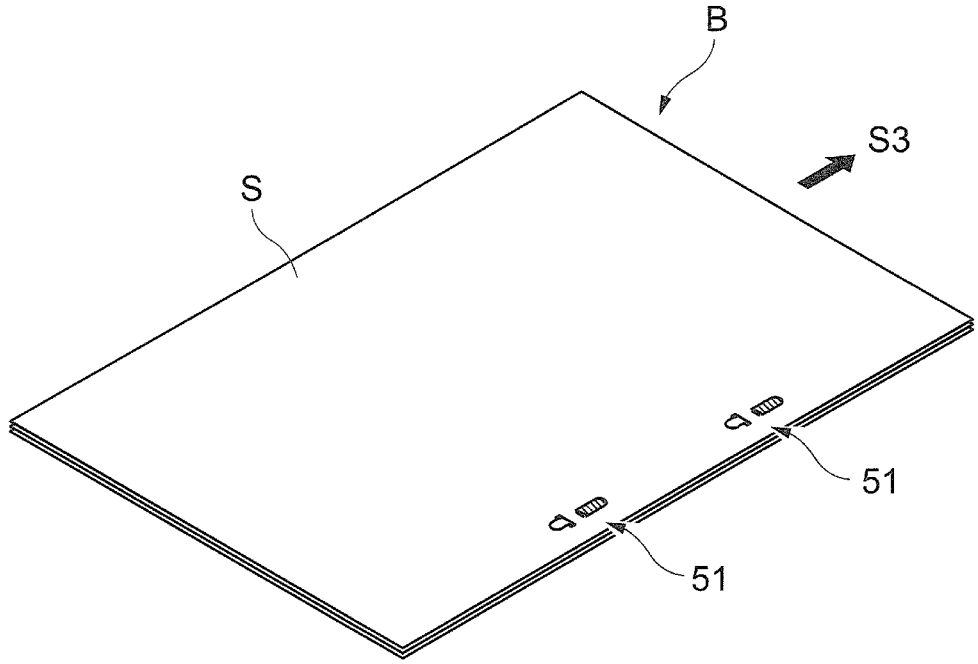
FIGS. 8A and 8B are schematic configuration diagrams showing other modes of the sheet stack subjected to the binding process.
Figure 8B:
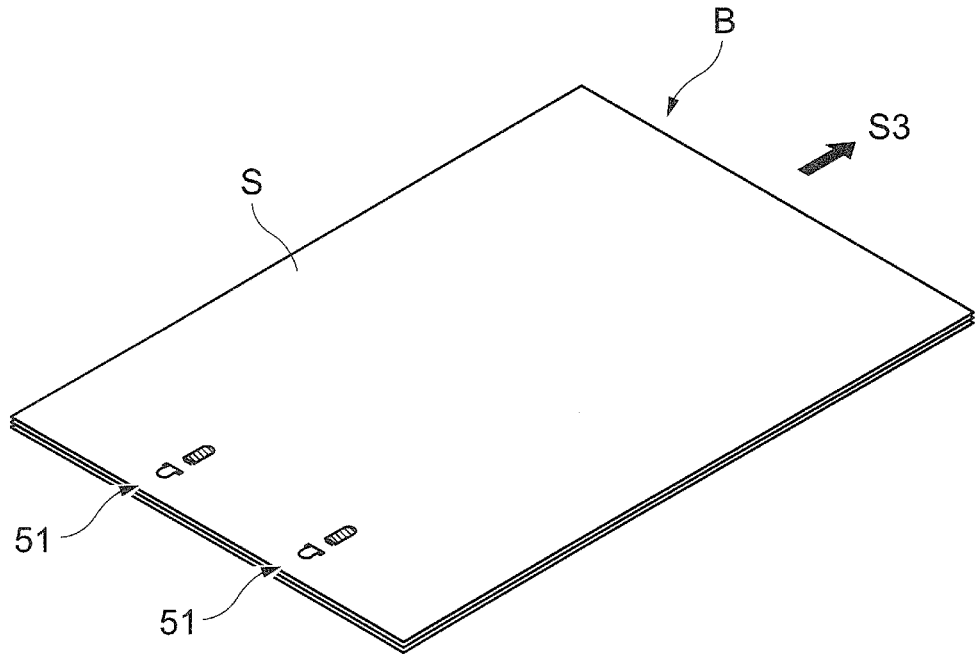

For example, as shown in FIG. 8A, two binding sections 51 may be arranged along the third traveling direction S3 by driving the moving mechanism 44 and the rotating mechanism 46 in combination. Further, as shown in FIG. 8B, two binding sections 51 may be arranged in the direction intersecting the third traveling direction S3. Still further, three or more binding sections 51 may be formed in the sheet stack B.

In each binding section 51 in each sheet stack B shown in FIGS. 8A and 8B, the root of the tongue portion 522 is arranged on the downstream side of the tip thereof in the third traveling direction S3. It should be noted that, in the examples shown in the figures, each binding section 51 is arranged in the same orientation with respect to each sheet stack B. Accordingly, the possibility that the tongue portion 522 is caught on other members as the sheet stack B is transported is suppressed in each and every tongue portion 522.

It should be noted that, in the above-described exemplary embodiment, description is given to the configuration in which the tongue portion 522 is arranged along the third traveling direction S3; however, the present invention is not limited thereto. As long as the configuration is such that the root of the tongue portion 522 is arranged on the downstream side of the tip thereof in the third traveling direction S3, for example, the longitudinal direction of the tongue portion 522 may be oblique with respect to the third traveling direction S3.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A post-processing device comprising:

a staple-less binding unit that forms a cut in a sheet stack and cuts a part of the sheet stack into a predetermined shape to form a tongue portion in the sheet stack, the tongue portion having a part where one end part of the tongue portion is not separated from the sheet stack, and binds the sheet stack by bending the tongue portion and inserting the other end part of the tongue portion into the cut; and a sheet stack transport unit that transports the sheet stack, wherein the binding unit binds an end portion of the sheet stack which is perpendicular to the sheet stack transport direction such that the one end part of the tongue portion in the sheet stack bound by the binding unit is on a upstream side of the other end part of the tongue portion in the sheet stack transport direction, wherein the binding unit comprises a cut forming unit and a tongue portion forming unit, and wherein the tongue portion forming unit is disposed on a downstream side in the sheet stack transport direction with respect to the cut forming unit.

2. The post-processing device according to claim 1, wherein the sheet stack transport unit transports the sheet stack in a direction along a longitudinal direction of the tongue portion inserted into the cut.

3. The post-processing device according to claim 2, wherein the binding unit binds the sheet stack at a plurality of positions in the sheet stack.

4. The post-processing device according to claim 3, wherein each tongue portion formed in each of the plurality of positions in the sheet stack is in a same orientation.

5. The post-processing device according to claim 1, wherein the binding unit binds the sheet stack at a plurality of positions in the sheet stack.

6. The post-processing device according to claim 5, wherein each tongue portion formed in each of the plurality of positions in the sheet stack is in a same orientation.

7. The post-processing device according to claim 1, wherein the tongue portion comprises:

a first tongue portion disposed on a first side of the sheet stack; and a second tongue portion disposed on a second side of the sheet stack perpendicular to the first side, wherein the first tongue portion and the second tongue portion comprise the same orientation with respect to the sheet stack transport direction.

8. The post-processing device according to claim 1, wherein the binding unit comprises a cut forming unit that forms a cut in the sheet stack and a tongue portion forming unit that cuts a part of the sheet stack into a predetermined shape to form the tongue portion in the sheet stack, and wherein the post-processing device further comprises a rotation mechanism that rotates a direction of the tongue portion forming unit with respect to the sheet stack to change a direction of the tongue portion formed in the sheet stack.

9. The post-processing device according to claim 8, wherein the binding unit is movable along a first end portion of the sheet stack and a second end portion of the sheet stack which is perpendicular to the first end portion, and the rotation mechanism rotates the direction of the tongue portion forming unit with respect to the sheet stack to change the direction of the tongue portion formed in the sheet stack based on whether the binding unit is arranged on the first end portion or on the second end portion of the sheet stack.

10. An image forming apparatus comprising:

an image forming mechanism that forms an image on a sheet;

a sheet stack forming mechanism that forms a sheet stack by bundling a plurality of sheets, on each of which the image is formed by the image forming mechanism;

a staple-less binding unit that forms a cut in the sheet stack formed by the sheet stack forming mechanism and cuts a part of the sheet stack into a predetermined shape to form a tongue portion in the sheet stack, the tongue portion having a part where one end part of the tongue portion is not separated from the sheet stack, and binds the sheet stack by bending the tongue portion and inserting the other end part of the tongue portion into the cut; and a sheet stack transport unit that transports the sheet stack, wherein the binding unit binds an end portion of the sheet stack which is perpendicular to the sheet stack transport direction such that the one end part of the tongue portion in the sheet stack bound by the binding unit is on a upstream side of the other end part of the tongue portion in the sheet stack transport direction, wherein the binding unit comprises a cut forming unit and a tongue portion forming unit, and wherein the tongue portion forming unit is disposed on a downstream side in the sheet stack transport direction with respect to the cut forming unit.

11. The image forming apparatus according to claim 10, wherein the tongue portion comprises:

a first tongue portion disposed on a first side of the sheet stack; and a second tongue portion disposed on a second side of the sheet stack perpendicular to the first side, wherein the first tongue portion and the second tongue portion comprise the same orientation with respect to the sheet stack transport direction.

12. The image forming apparatus according to claim 10, wherein the binding unit comprises a cut forming unit that forms a cut in the sheet stack and a tongue portion forming unit that cuts a part of the sheet stack into a predetermined shape to form the tongue portion in the sheet stack, and wherein the image forming apparatus further comprises a rotation mechanism that rotates a direction of the tongue portion forming unit with respect to the sheet stack to change a direction of the tongue portion formed in the sheet stack.

13. The image forming apparatus according to claim 12, wherein the binding unit is movable along a first end portion of the sheet stack and a second end portion of the sheet stack which is perpendicular to the first end portion, and the rotation mechanism rotates the direction of the tongue portion forming unit with respect to the sheet stack to change the direction of the tongue portion formed in the sheet stack based on whether the binding unit is arranged on the first end portion or on the second end portion of the sheet stack.

* * * * *